US006760562B2

(12) United States Patent
Nishida et al.

(10) Patent No.: US 6,760,562 B2
(45) Date of Patent: Jul. 6, 2004

(54) IMAGE FORMING APPARATUS

(75) Inventors: Satoshi Nishida, Toyko (JP); Hiroaki Miho, Tokyo (JP); Shigetaka Kurosu, Tokyo (JP); Hiroshi Morimoto, Tokyo (JP); Masashi Saito, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/463,140

(22) Filed: Jun. 16, 2003

(65) Prior Publication Data

US 2003/0235439 A1 Dec. 25, 2003

(30) Foreign Application Priority Data

Jun. 20, 2002 (JP) ..... 2002-179831

(51) Int. Cl.[7] ..... G03G 15/16; G03G 15/00
(52) U.S. Cl. ..... 399/297; 399/159
(58) Field of Search ..... 399/159, 297, 399/302, 313; 430/56, 58

(56) References Cited

U.S. PATENT DOCUMENTS 5,905,008 A * 5/1999 Yoshinaga et al. ..... 430/58.2
6,108,502 A * 8/2000 Kawada et al. ..... 399/159
6,535,710 B2 * 3/2003 Takeshima et al. ..... 399/279

* cited by examiner

*Primary Examiner*—Hoang Ngo
(74) *Attorney, Agent, or Firm*—Frishauf, Holtz, Goodman & Chick, P.C.

(57) ABSTRACT

This invention relates to an image forming apparatus. The image forming apparatus includes a primary transfer means for bringing one surface of an intermediate transfer body and/or transfer medium into contact with a photosensitive body surface and pressing the surface against the photosensitive body surface to transfer a toner image formed on the photosensitive body surface onto one surface of the intermediate transfer body and/or transfer medium. When a time of passage through the contact transfer area between the photosensitive body and the intermediate transfer body and/or transfer medium in the process of transferring the toner image from the photosensitive body onto the intermediate transfer body and/or transfer medium is T, T1, or T2 sec, the contact angle of the photosensitive body with respect to pure water applied to the photosensitive body surface after a lapse of T, T1, or T2 sec since application of the pure water is larger than that of the intermediate transfer body and/or transfer medium with respect to the pure water after a lapse of the T, T1, or T2 sec.

22 Claims, 6 Drawing Sheets

IMAGE FORMING APPARATUS

BACKGROUND OF THE INVENTION

1. Field of the Invention

The present invention relates to an image forming apparatus and, more particularly, to an image forming apparatus which achieves an improvement in transfer performance by regulating the interfacial tensions of a photosensitive body, intermediate transfer body, transfer medium, primary transfer means, and secondary primary means with respect to pure water.

2. Description of the Prior Art

In conventional image forming apparatuses using an electrophotographic method, transfer operation is facilitated and a poor transfer phenomenon, in particular, such a phenomenon as a part of character or line is left out due to toner cohesion is reduced by, for example, a method of electrostatically facilitating transfer operation by regulating the relationship in surface energy between a photosensitive body and a transfer medium, a photosensitive body and an intermediate transfer body, and an intermediate transfer body and a transfer medium or regulating the relationship in contact angle with respect to pure water, and a method of making it easy for toner to move in a transfer direction even in the event of toner cohesion due to the pressure exerted by a transfer section (see Japanese Unexamined Patent Publication No. 08-211755, U.S. Pat. No. 5,732,314, and Japanese Unexamined Patent Publication No. 07-152263).

In each of these methods, the relationships in contact angle, surface energy, and surface tension between a member holding toner and a member on which the toner is to be transferred are regulated. However, there is no description about temporal values or changes over time.

Various materials are used for a photosensitive body, intermediate transfer body, and transfer medium used in an electrophotographic apparatus. Such a component is rarely made of a single material. In general, ozone or nitrate adheres to a photosensitive body serving as an image carrier because it is electrostatically charged. In addition, as toner and carrier are used in a developing process, toner components or external additive components adhere to the photosensitive body. In a transfer process, a transfer medium such as a paper sheet comes into direct contact with a photosensitive body or intermediate transfer body serving as an image carrier, and hence calcium carbonate, talc, or the like which is a paper component adheres to the image carrier.

As is obvious, surface roughness has influence on the surface energy of a photosensitive body or intermediate transfer body serving as an image carrier, the surface energy of a paper sheet as a transfer medium, and a contact angle with respect to pure water which is used to obtain such surface energy. The present inventors have found that the contact angle is greatly influenced by the surface state of a target member. In other words, the present inventors have found that the contact angle is greatly influenced by a substance adhering to the surface. In particular, the contact angle greatly changes depending on the time elapsed after pure water is applied. When a substance adheres to a target member, the contact angle greatly changes. The relationship in contact angle between a member holding toner or the like and a member on which the toner is to be transferred is reversed when changes over time are neglected.

SUMMARY OF THE INVENTION

The present invention has been made to solve the above problems in the prior art, and has as its object to provide an image forming apparatus which exhibits high transfer performance and forms high-quality images by regulating the surface physical properties of a member holding toner and a member on which the toner is to be transferred, and more specifically, contact angles, surface energies, and surface tensions, in consideration of changes in them over time.

In order to achieve the above object, according to the first aspect of the present invention, there is provided an image forming apparatus, comprising: transfer means to transfer a toner image formed on the photosensitive body surface onto one surface of the transfer medium, characterized in that when a time of passage through a contact transfer area between the photosensitive body and the transfer medium in a process of transferring the toner image from the photosensitive body onto the transfer medium is T sec, a contact angle of the photosensitive body with respect to pure water applied to the photosensitive body surface after a lapse of T sec since application of the pure water is larger than a contact angle of the transfer medium with respect to the pure water after a lapse of the T sec.

According to the second aspect of the present invention, there is provided an image forming apparatus described in the first aspect, wherein the transfer means comprises primary transfer means for bringing one surface of a transfer medium into contact with a photosensitive body surface and pressing the surface of the transfer medium against the photosensitive body surface.

According to the third aspect of the present invention, there is provided an image forming apparatus described in the first aspect, wherein the transfer means comprises primary transfer means for bringing one surface of an intermediate transfer body into contact with a photosensitive body surface and pressing the surface of the intermediate transfer body against the photosensitive body surface to transfer a toner image formed on the photosensitive body surface onto one surface of the intermediate transfer body, and secondary transfer means for bringing a transfer surface of the intermediate transfer body and one surface of a transfer medium into contact with each other and compressing the transfer surface and one surface of the transfer medium against each other to transfer the toner image formed on the transfer surface of the intermediate transfer body onto one surface of the transfer medium, wherein when a time of passage through a contact transfer area between the photosensitive body and the intermediate transfer body in a process of transfer operation from the photosensitive body to the intermediate transfer body is T1 sec, a contact angle of the photosensitive body with respect to pure water applied to the photosensitive body surface after a lapse of T1 sec since application of the pure water is larger than a contact angle of the intermediate transfer body with respect to the pure water after a lapse of the T1 sec, and when a time of passage through a contact transfer area between the intermediate transfer body and the transfer medium in a process of transfer operation from the intermediate transfer body to the transfer medium is T2 sec, a contact angle of the intermediate transfer body with respect to pure water applied to a surface of the intermediate transfer body after a lapse of T2 sec since application of the pure water is larger than a contact angle of the transfer medium with respect to the pure water after a lapse of the T2 sec.

According to the fourth aspect of the present invention, there is provided an image forming apparatus described in the third aspect, characterized in that when a time of passage through a contact transfer area between the intermediate transfer body and the transfer medium in a process of transfer operation from the intermediate transfer body to the transfer medium is T sec, a contact angle of the intermediate transfer body with respect to pure water applied to a surface of the intermediate transfer body after a lapse of T sec since application of the pure water is larger than a contact angle of the secondary transfer means with respect to the pure water after a lapse of the T sec.

According to the fifth aspect of the present invention, there is provided an image forming apparatus described in one of the first to fourth aspects, wherein contact angle adjustment for pure water in the time of passage through the contact transfer area is performed by applying a lubricant.

According to the sixth aspect of the present invention, there is provided an image forming apparatus described in one of the first to fourth aspects, wherein contact angle adjustment for pure water in the time of passage through the contact transfer area is performed by adjustment of surface roughness.

According to the seventh aspect of the present invention, there is provided an image forming apparatus described in one of the first to fourth aspects, wherein contact angle adjustment for pure water in the time of passage through the contact transfer area is performed by wettability adjustment based on plasma discharge.

According to the eighth aspect of the present invention, there is provided an image forming apparatus described in the first aspect, wherein transfer rollers formed from an elastic member are used as the transfer means.

According to the ninth aspect of the present invention, there is provided an image forming apparatus described in one of the first to third aspects, wherein a constant current source which outputs a constant current of 1 to 200 $\mu$A with a polarity opposite to that of charged toner is used as the transfer means.

According to the tenth aspect of the present invention, there is provided an image forming apparatus described in the eighth aspect, wherein the transfer roller has a real resistance of $1\times10^5$ to $1\times10^{10}\Omega$.

According to the eleventh aspect of the present invention, there is provided an image forming apparatus described in the first aspect, wherein the toner has a number average particle diameter of 3 to 8 $\mu$m.

According to the twelfth aspect of the present invention, there is provided an image forming apparatus described in one of the first to eleventh aspects, wherein the photosensitive body has a drum-like shape.

According to the thirteenth aspect of the present invention, there is provided an image forming apparatus described in one of the third aspect, wherein the secondary transfer means for the transfer medium comprises an intermediate transfer body and a backup roller and secondary transfer roller which sandwich the intermediate transfer body, and performs constant current control, with the backup roller having a resistance of $1\times10^{15}$ to $1\times10^7\Omega$, and the secondary transfer roller having a resistance of $1\times10^5$ to $1\times10^7\Omega$.

According to the fourteenth aspect of the present invention, there is provided an image forming apparatus described in the ninth or eleventh aspect, wherein a coefficient of variation for a shape factor of the toner is not more than 16%, and a number coefficient of variation in a number particle size distribution is not more than 27%.

According to the fifteenth aspect of the present invention, there is provided an image forming apparatus described in the third aspect, wherein a relative position of the primary transfer means is within 10 mm on upstream and downstream sides of the central point of a contact transfer area between the photosensitive body and the intermediate transfer body in a rotational direction.

According to the sixteenth aspect of the present invention, there is provided an image forming apparatus described in the third aspect, wherein the primary transfer means is located downstream of the central point of a contact transfer area between the intermediate transfer body and the photosensitive body in a traveling direction of the intermediate transfer body.

According to the seventeenth aspect of the present invention, there is provided an image forming apparatus described in the third aspect, wherein a relative position of a secondary transfer roller serving as the secondary transfer means for performing transfer operation from the intermediate transfer body to the transfer medium is within 20 mm on upstream and downstream sides of the central point of a contact area between the intermediate transfer body and a backup roller in a rotational direction.

According to the eighteenth aspect of the present invention, there is provided an image forming apparatus described in the third aspect, wherein a nip forming roller which forms a nip between the photosensitive body and the intermediate transfer body is movable and is released except for image forming operation.

According to the nineteenth aspect of the present invention, there is provided an image forming apparatus described in the eighteenth aspect, wherein the nip forming roller is made of a metal and has no driving means for rotation.

According to the twenty aspect of the present invention, there is provided an image forming apparatus described in the third aspect, wherein the intermediate transfer body is placed in correspondence with a plurality of photosensitive bodies and developing units.

According to the twenty-one aspect of the present invention, there is provided an image forming apparatus described in the twenty aspect, wherein toner images are primarily transferred from the plurality of photosensitive bodies to one intermediate transfer body, and the toner images on the intermediate transfer body are secondarily transferred onto a transfer medium together.

According to the twenty-two aspect of the present invention, there is provided an image forming apparatus described in any one of the first, eleventh and fourteenth aspects, wherein a two-component developing agent constituted by toner and a carrier is used as the toner.

As is obvious from the above aspects, according to the present invention, the relationships in surface physical properties, and more specifically, contact angle, surface energy, and surface tension, between a member holding toner, such as a photosensitive body or intermediate transfer body, and a member on which the toner is to be transferred, such as an intermediate transfer body or transfer medium, are clarified in consideration of changes over time, and an image forming apparatus can be provided, which exhibits high transfer performance and forms high-quality images without causing any trouble such as poor transfer by regulating the physical properties.

The above and many other objects, features and advantages of the present invention will become manifest to those skilled in the art upon making reference to the following detailed description and accompanying drawings in which preferred embodiments incorporating the principle of the invention are shown by way of illustrative examples.

DETAILED DESCRIPTION OF THE PREFERRED EMBODIMENTS

Several preferred embodiments of the present invention will be described below with reference to the accompanying drawings. Note that the following description will not limit the technical range of claims or the meanings of terms.

Note also that the assertive description in the embodiments of the present invention will exemplify the best mode but will not limit the meanings of terms and the technical range of the present invention.

Figure 1:
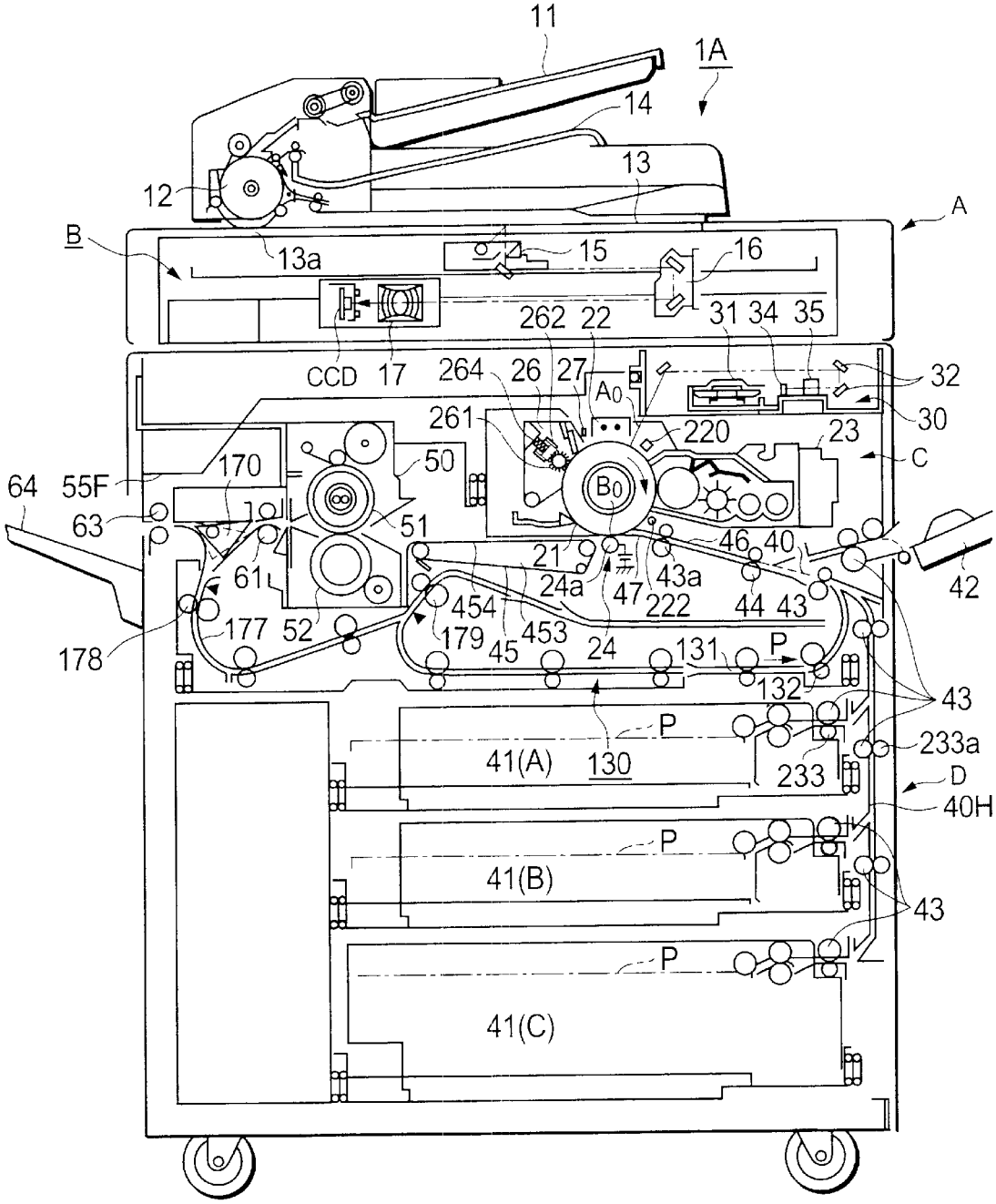
FIG. 1 is a sectional view showing the arrangement of a monochrome image forming apparatus according to an embodiment of the present invention.

The image forming apparatus shown in FIG. 1 is a monochrome image forming apparatus 1A in digital form according to an embodiment of the present invention. This apparatus is comprised of an image reading section A, an image processing section B, an image forming section C, and a transfer medium convey section D serving as a transfer medium convey means.

An automatic document feeding means for automatically feeding documents is mounted on the image reading section A. Documents placed on a document table 11 are separated and conveyed one by one by a document convey roller 12. An image is read at a reading position 13*a*. A document having undergone document reading operation is discharged onto a document discharge tray 14 by the document convey roller 12.

An image on a document placed on a platen glass 13 is read by causing a first mirror unit 15 constituted by an illumination lamp and first mirror, which constitute a scanning optical system, to perform reading operation at a velocity v, and causing a second mirror unit 16 constituted by second and third mirrors positioned in a V shape to move at a velocity v/2 in the same direction.

The read image is formed on the light-receiving surface of an image sensing device (CCD) serving as a line sensor through a projection lens 17. The optical image in the form of a line formed on the image sensing device (CCD) is photoelectrically converted into an electrical signal (luminance signal) sequentially. This signal is A/D-converted and subjected to processing such as density conversion and filter processing in the image processing section B. The resultant image data is temporarily stored in a memory.

In the image forming section C, the following components constituting an image forming unit are arranged around a drum-like photosensitive body 21 serving as an image carrier in operation order: a charging means 22 for charging the photosensitive body 21, a potential detecting means 220 for detecting the surface potential of the charged photosensitive body, a developing means 23, a transfer convey belt unit 45 serving as a transfer means, a cleaning means 26 for the photosensitive body 21, and a PCL (Pre-Charge Lamp) 27.

Figure 4:
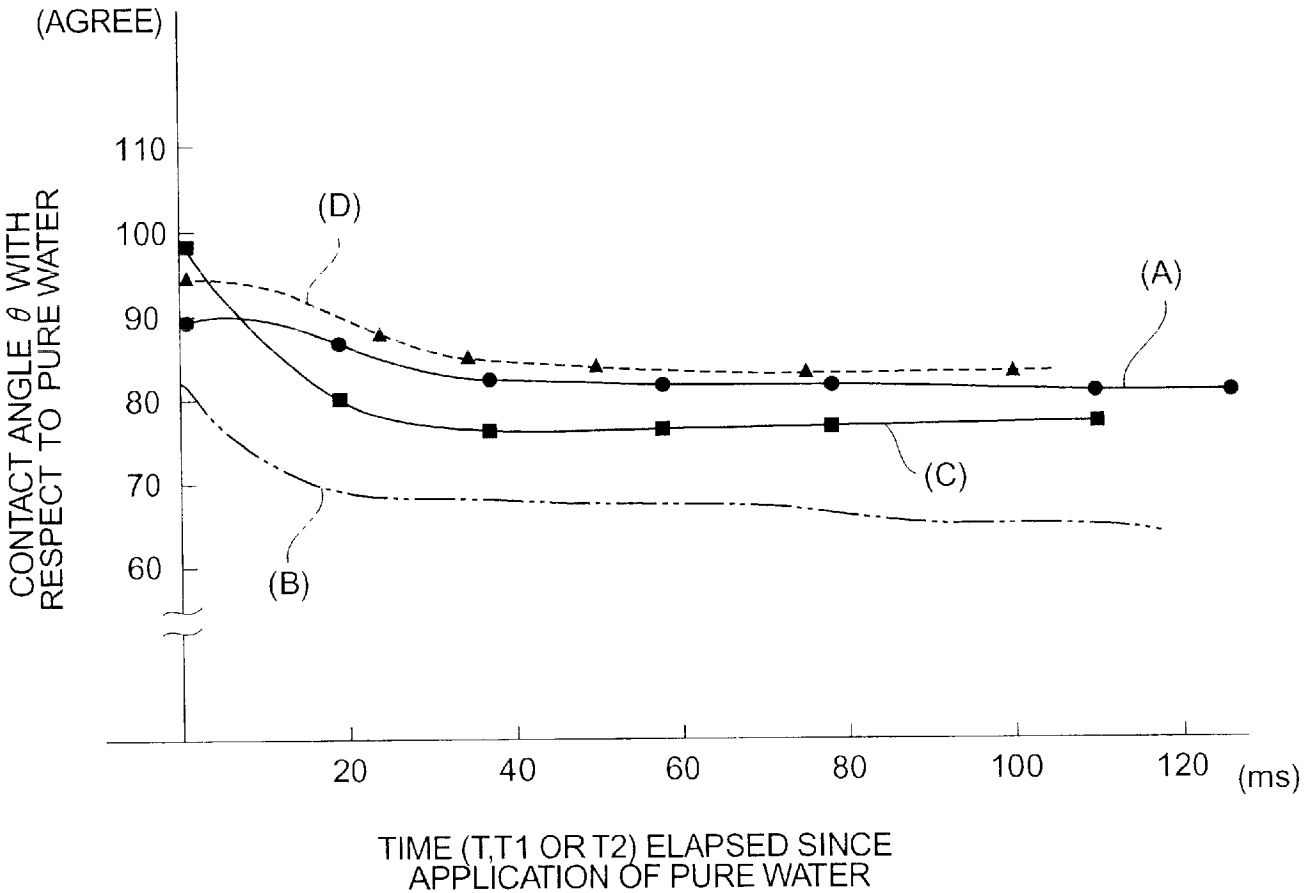
FIG. 4 is a graph showing changes in contact angle with respect to pure water as a function of the time elapsed since the application of pure water to various objects to be tested.
Figure 5A:
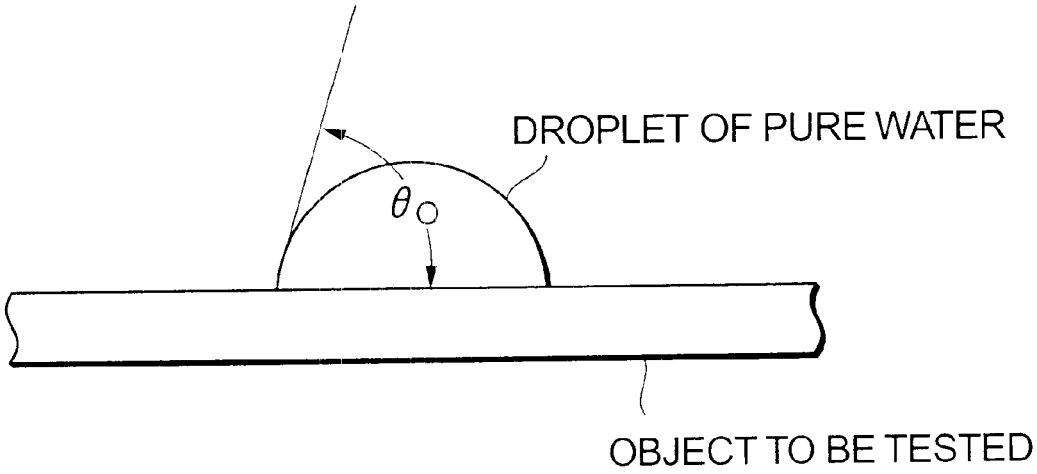
FIGS. 5A and 5B are schematic views each showing the contact angle of an object to be tested with respect to pure water.
Figure 5B:
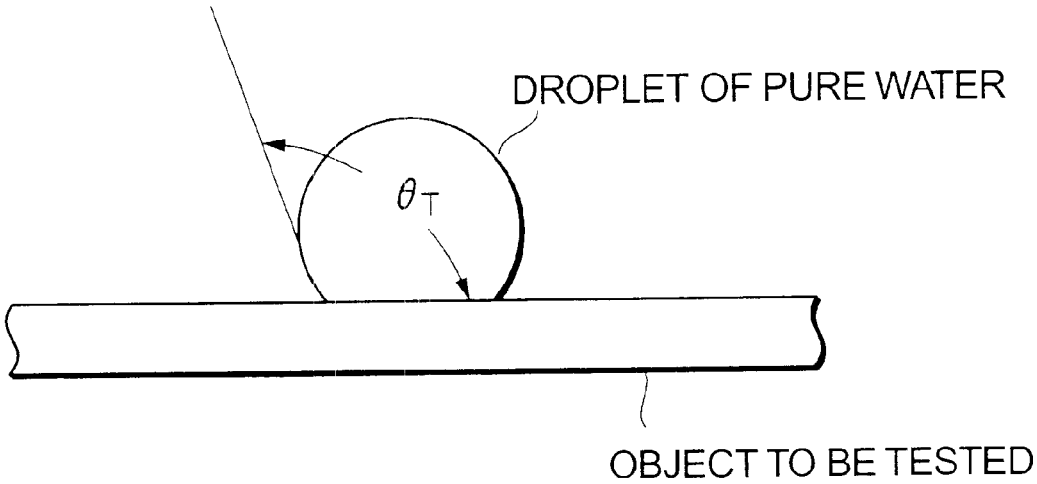

As one surface of a transfer medium P comes into contact with the surface of the photosensitive body 21 and passes through a contact transfer area for primary transfer operation, the physical properties of the surfaces of the photosensitive body 21 and transfer medium P, the surface tensions in particular, change. As indicated by the graph of FIG. 4, the surface states greatly change from the initial states immediately after a time T has elapsed since the transfer medium P passed through the contact transfer area, and remain almost unchanged afterward. In this case, the surface tension of the photosensitive body 21 or transfer medium P is represented by each of the values obtained by measuring a contact angle θ between a droplet of pure water and the photosensitive body 21 or transfer medium P as an object to be tested, as shown in FIGS. 5A and 5B, at the time the droplet is applied onto the object, after a lapse of T sec, and at predetermined time intervals afterward. It was found that the contact angle changed from an initial contact angle $\theta_o$ shown in FIG. 5A to a contact angle $\theta_T$ shown in FIG. 5B after a lapse of T sec, and remained almost unchanged afterward. The graph of FIG. 4 indicates this result. A curve (A) represents the contact angles associated with the photosensitive body 21. A curve (B) represents the contact angles associated with the transfer medium P The relation between the contact angles $\theta_T$ after a lapse of T sec is represented by (A)>(B).

Note that when the difference in contact angle θ between the photosensitive body 21 and the transfer medium P is small or the relationship in magnitude is reversed, a means for forcibly making this difference can be effectively used to set the above curves (A) and (B). This means will be described next.

The cleaning means 26 has a cleaning brush roller 261, a solid lubricant 262, and a spring 264 which presses the lubricant against the cleaning brush roller 261. The pressing force is set to 1.96 N, and the thrust depth of the solid lubricant 262 into the cleaning brush roller 261 is set to about 1 mm. As the surface of the photosensitive body 21 is lubricated through the cleaning brush roller 261, the surface tension decreases. As will be described later, as the contact angle θ with respect to pure water increases, the wettability decreases to allow the toner image on the photosensitive body to be transferred onto the transfer medium P more easily. In the prior art, for example, excessive transfer pressure in a transfer process causes toner cohesion, resulting in a poor transfer phenomenon. The present invention is free from a poor transfer phenomenon and the like due to toner cohesion, and can obtain stable, high-quality transferred images.

The photosensitive body 21 is obtained by coating a drum-like base member with a photoconductive compound. For example, an OPC (Organic-Photo Conductor) is suitably used, which is driven/rotated clockwise in FIG. 1.

After the rotating photosensitive body 21 is uniformly charged by the charging means 22, image exposure based on an image signal read out from the memory in the image processing section B is performed by an exposure optical system 30 serving as an image exposure means. The exposure optical system 30 serving as an image exposure means which is a write means uses a laser diode (not shown) as a light source, and performs main scanning by bending an optical path passing through a rotating polygon mirror 31, fθ lens 34, and cylindrical lens 35 by a reflecting mirror 32. The exposure optical system 30 performs image exposure on the photosensitive body 21 at a position Ao to form a latent image upon rotation of (sub-scanning) of the photosensitive body 21. In this embodiment, exposure is performed on a character portion to form a latent image.

The developing means 23 performs reversal development of the latent image on the photosensitive body 21 to form a visible toner image on the surface of the photosensitive body 21. The transfer medium convey section D has paper feed units 41*a*, 41*b*, and 41*c*, below the image forming unit, which serve as transfer medium storing means in which transfer mediums P with different sizes are stored, and also has a manual paper feed unit 42, on the side of the apparatus, which is used to manually feed a sheet. Each of the transfer mediums P fed from the paper feed units 41*a*, 41*b*, and 41*c* passes through guide rollers 233 and 233*a* and vertical convey path 40H, and is fed along a convey path 40 by guide rollers 43. After the transfer medium P is temporarily stopped by a registration roller pair 44 for correcting any tilt and deviation of the fed transfer medium P, it is guided to a paper feed path 46 and entrance guide plate 47. The toner image on the photosensitive body 21 is transferred onto the transfer medium P at a transfer position Bo by a primary transfer roller 24*a* serving as a primary transfer means 24 and separation pole.

The transfer medium P is then placed on a transfer convey belt 454 of the transfer convey belt unit 45, separated from the surface of the photosensitive body 21 while being conveyed, and conveyed to a fixing unit 50 by the transfer convey belt unit 45.

The fixing unit 50 has a fixing roller serving as a fixing member 51 formed from a hollow rotating member F and a pressure roller serving as a pressure member 52 which presses the fixing roller. By making the transfer medium P pass between the fixing member 51 and the pressure member 52, the toner on the transfer medium P is fixed by heat and pressure. The transfer medium P on which the toner image is fixed is discharged onto a paper discharge tray 64.

The above description has exemplified the state wherein an image is formed on one surface of the transfer medium P. When double-sided copy operation is to be performed, a paper discharge switching member 170 is switched to open a sheet guide section 177 to convey the transfer medium P in the direction indicated by the broken-line arrow.

The transfer medium P is further conveyed downward by a convey mechanism 178, and switched back by a sheet reversing section 179. As a consequence, the transfer medium P is conveyed into a double-sided copy paper feed unit 130 with its trailing end becoming a leading end.

The transfer medium P moves on a convey guide 131 provided in the double-sided copy paper feed unit 130 in the paper feed direction. The transfer medium P is then re-fed by feed rollers 132 and guided to the convey path 40.

Subsequently, as described above, the transfer medium P is conveyed again toward the photosensitive body 21, and a toner image is transferred onto the lower surface of the transfer medium P and fixed by the fixing unit 50. The resultant sheet is discharged onto the paper discharge tray 64.

The above description is about the monochrome image forming apparatus designed to complete transfer of images by only primary transfer operation.

A color image forming apparatus 1B shown in FIG. 2 will be described next.

The color image forming apparatus 1B is called a tandem type color image forming apparatus, which is comprised of a plurality of image forming sections 10Y, 10M, 10C, and 10K, an endless belt intermediate transfer member unit 7, a paper feed convey means 41, and a fixing unit 50 serving as a fixing means. A document image reader SC is mounted on a main body. A of the color image forming apparatus 1B. An illustration of an automatic document feeding means is omitted.

The image forming section 10Y for forming yellow images includes a drum-like photosensitive body 21Y serving as the first image carrier, and the following components arranged around the photosensitive body 21Y: a charging means 22Y, an exposure means 30Y, a developing means 23Y, a primary transfer roller 24Y serving as a primary transfer means, and a cleaning means 26Y.

The image forming section 10M for forming magenta images includes a drum-like photosensitive body 21M serving as the first image carrier, and the following components arranged around the photosensitive body 21M: a charging means 22M, an exposure means 30M, a developing means 23M, a primary transfer roller 24M serving as a primary transfer means, and a cleaning means 26M.

The image forming section 10C for forming cyan images includes a drum-like photosensitive body 21C serving as the first image carrier, and the following components arranged around the photosensitive body 21C: a charging means 22C, an exposure means 30C, a developing means 23C, a primary transfer roller 24C serving as a primary transfer means, and a cleaning means 26C.

The image forming section 10K for forming black images includes a drum-like photosensitive body 21K serving as the first image carrier, and the following components arranged around the photosensitive body 21K: a charging means 22K, an exposure means 30K, a developing means 23K, a primary transfer roller 24K serving as a primary transfer means, and, a cleaning means 26K.

As the photosensitive bodies 21Y, 21M, 21C, and 21K come into contact with an endless belt intermediate transfer member 70, and the transfer member 70 passes through the respective contact transfer areas for primary transfer operation, the physical properties of the surfaces of the photosensitive bodies 21Y, 21M, 21C, and 21K and endless belt intermediate transfer member 70, the surface tensions in particular, change. As indicated by the graph of FIG. 4, the surface states greatly change from the initial states immediately after a time T1 has elapsed since the transfer member 70 passed through each contact transfer area, and remain almost unchanged afterward. In this case, the surface tension of the photosensitive body or endless belt intermediate transfer member 70 is represented by each of the values obtained by measuring a contact angle θ between a droplet of pure water and the photosensitive body or transfer member 70 as an object to be tested, as shown in FIGS. 5A and 5B, at the time the droplet is applied onto the object, after a lapse of T1 sec, and at predetermined time intervals afterward. It was found that the contact angle changed from an initial contact angle $\theta_o$ shown in FIG. 5A to a contact angle $\theta_T$ shown in FIG. 5B after a lapse of T1 sec, and remained almost unchanged afterward. The graph of FIG. 4 indicates this result. A curve (A) represents the contact angles associated with the photosensitive body. A curve (C) represents the contact angles associated with the intermediate transfer member 70. The relation between the contact angles θ is represented by (A)>(C).

Note that when the difference in contact angle θ between each of the photosensitive bodies 21Y, 21M, 21C, and 21K and the endless belt intermediate transfer member 70 is small or the relationship in magnitude is reversed, a means for forcibly making this difference can be effectively used to set the above curves (A) and (C). This means will be described next.

Figure 2:
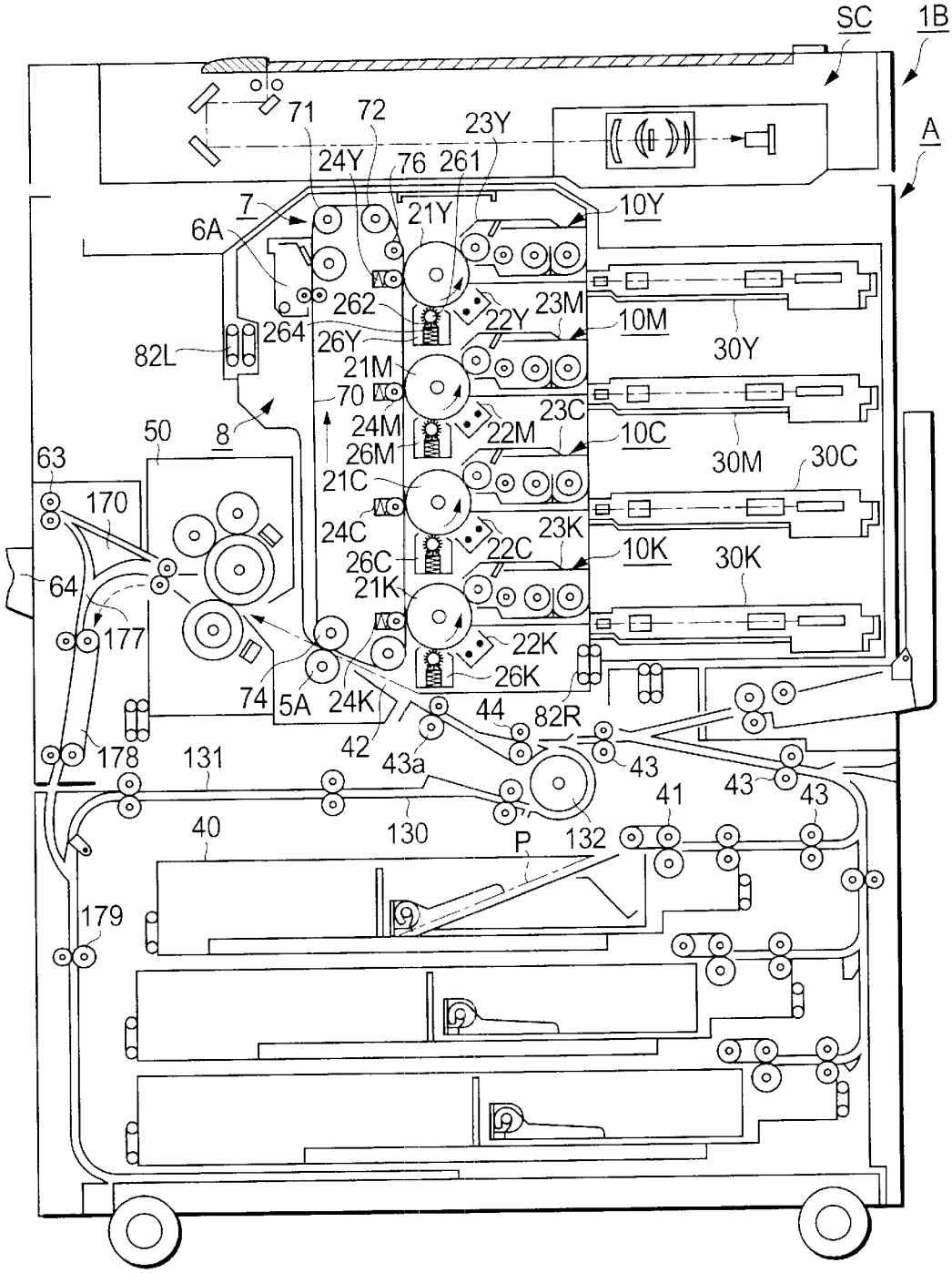
FIG. 2 is a sectional view showing the arrangement of a color image forming apparatus according to another embodiment of the present invention.
Figure 6:
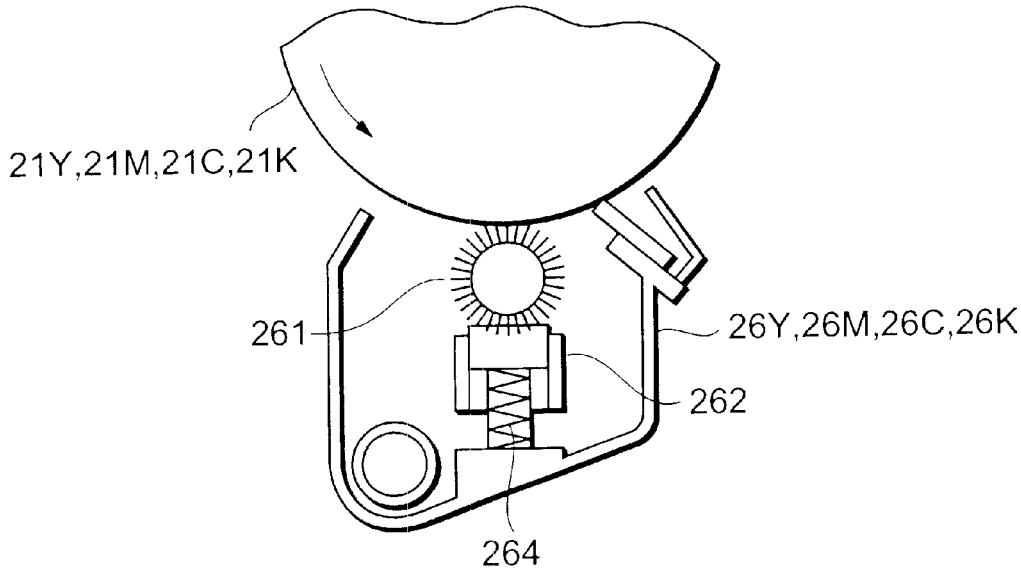
FIG. 6 is a schematic view showing how a lubricant is applied by a cleaning means.
Figure 7:
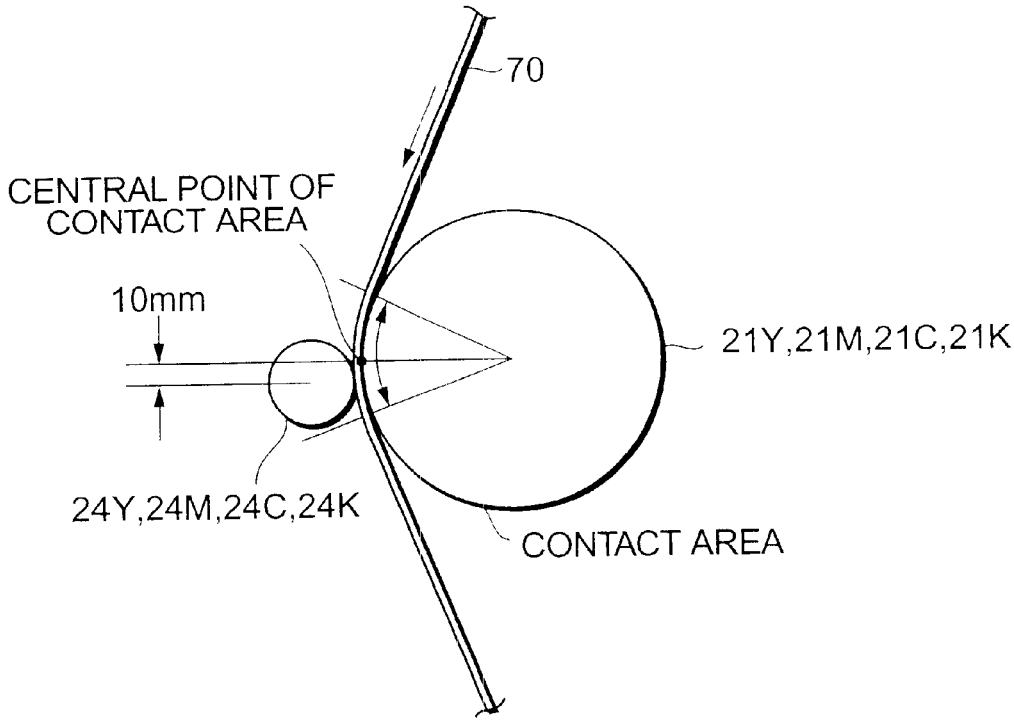
FIG. 7 is a schematic view showing the positional relationship between a photosensitive body, an intermediate transfer body, and a primary transfer roller.

As is obvious from FIG. 2 showing the cross-sectional arrangement of the color image forming apparatus 1B and FIG. 6 showing the schematic arrangement of the cleaning means, each of the cleaning means 26Y, 26M, 26C, and 26K has a cleaning brush roller 261, a solid lubricant 262 mounted on a holder 263, and a spring 264 which presses the lubricant against the cleaning brush roller 261. The pressing force is set to 1.96 N, and the thrust depth of the solid lubricant 262 into the cleaning brush roller 261 is set to about 1 mm. As the surface of each of the photosensitive bodies 21Y, 21M, 21C, and 21M is lubricated through the cleaning brush roller 261, the surface tension decreases. As the contact angle with respect to pure water increases, the wettability decreases to allow the toner image on the photosensitive body to be transferred onto the endless belt intermediate transfer member 70 more easily. In the prior art, for example, excessive transfer pressure in a transfer process causes toner cohesion, resulting in a poor transfer phenomenon. The present invention is free from such a poor transfer phenomenon and the like due to toner cohesion, and can obtain stable, high-quality transferred images.

The endless belt intermediate transfer member unit 7 has the endless belt intermediate transfer member 70 (to be also simply referred to as the intermediate transfer member hereinafter) serving as the second image carrier in the form of a semiconductive endless belt pivotally wound around a plurality of rollers.

The images of the respective colors formed by the image forming sections 10Y, 10M, 10C, and 10K are sequentially transferred onto the pivoting endless belt intermediate transfer member 70 by the primary transfer rollers 24Y, 24M, 24C, and 24K to form a composite color image.

A transfer medium P as a recording medium stored in a paper feed cassette 40 is fed by the paper feed means 41 and conveyed to the position of the secondary transfer roller 5A serving as a secondary transfer means through a plurality of intermediate rollers 43 and 44, registration rollers 43*a*, and a convey path 42. The color image is then transferred onto the transfer medium P at once. The color image transferred onto the transfer medium P is fixed by the fixing unit 50. The transfer medium P is then clamped by paper discharge rollers 63 and placed on a paper discharge tray 64 mounted outside the apparatus.

The above description has exemplified the state wherein an image is formed on one surface of the transfer medium P. When double-sided copy operation is to be performed, a paper discharge switching member 170 is switched to open a sheet guide section 177 to convey the transfer medium P in the direction indicated by the broken-line arrow.

The transfer medium P is further conveyed downward by a convey mechanism 178, and switched back by a sheet reversing section 179. As a consequence, the transfer medium P is conveyed into a double-sided copy paper feed unit 130 with its trailing end becoming a leading end.

The transfer medium P moves on a convey guide 131 provided in the double-sided copy paper feed unit 130 in the paper feed direction The transfer medium P is then re-fed by feed rollers 132 and guided to the convey path 40.

In this manner, the transfer medium P is conveyed again to the above secondary transfer position, and a toner image is transferred onto the lower surface of the transfer medium P and fixed by the fixing unit 50. The resultant sheet is discharged onto the paper discharge tray 64.

After the color image is transferred onto the transfer medium P by the secondary transfer roller 5A serving as a secondary transfer means, a cleaning means 6A removes the residual toner from the endless belt intermediate transfer member 70 from which the transfer medium P is curvature-separated.

As the endless belt intermediate transfer member 70 and the transfer medium P come into contact with each other and the transfer medium P passes through a contact transfer area for secondary transfer operation, the physical properties of the surfaces of the endless belt intermediate transfer member 70 and transfer medium P, the surface tensions in particular, change. As indicated by the graph of FIG. 4, the surface states greatly change from the initial states immediately after a time T2 has elapsed since the transfer member 70 and transfer medium P passed through the contact transfer area, and remain almost unchanged afterward. In this case, the surface tension of the endless belt intermediate transfer member 70 or transfer medium P is represented by each of the values obtained by measuring a contact angle θ between a droplet of pure water and the endless belt intermediate transfer member or transfer medium as an object to be tested, as shown in FIGS. 5A and 5B, at the time the droplet is applied onto the object, after a lapse of T2 sec, and at predetermined time intervals afterward. It was found that the contact angle changed from an initial contact angle $\theta_o$ shown in FIG. 5A to a contact angle $\theta_T$ shown in FIG. 5B after a lapse of T2 sec, and remained almost unchanged afterward. The graph of FIG. 4 indicates this result. A curve (B) represents the contact angles associated with the transfer medium P. A curve (C) represents the contact angles associated with the intermediate transfer body. That is, the contact angle θ between the endless belt intermediate transfer member 70 and pure water is larger than that between the transfer medium P and pure water, and hence the toner image on the endless belt intermediate transfer member 70 is more easily transferred onto the transfer medium P. In the prior art, for example, in secondary transfer operation as well, excessive transfer pressure in a transfer process causes toner cohesion, resulting in a poor transfer phenomenon. The present invention is free from such a poor transfer phenomenon and the like due to toner cohesion, and can obtain stable, high-quality transferred images.

Note that the difference in contact angle θ between the endless belt intermediate transfer member 70 and the transfer medium P is small or the relationship in magnitude is reversed; a means for forcibly making this difference can be effectively used to set the above curves (B) and (C) This means will be described next.

Figure 3:
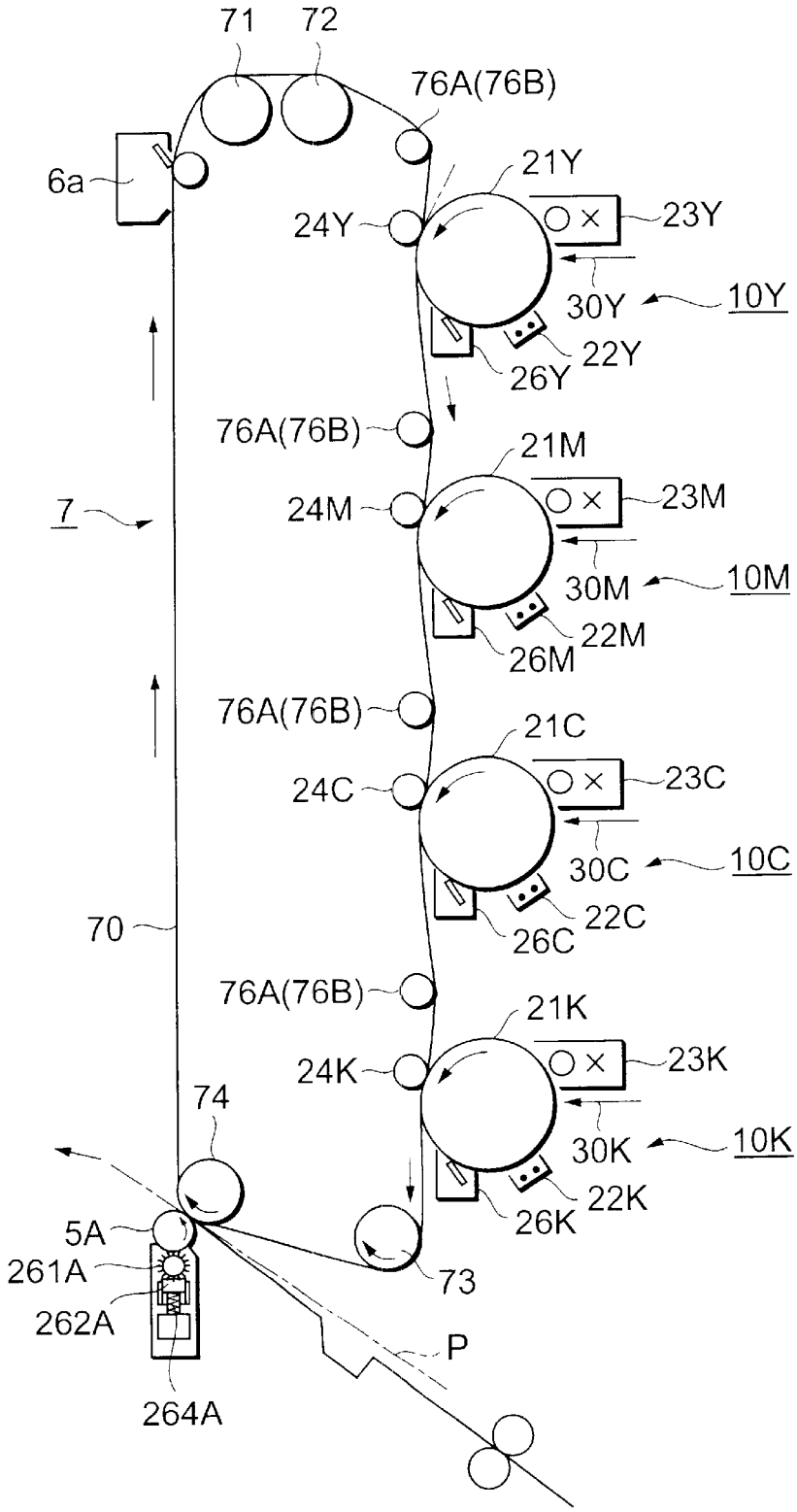
FIG. 3 is a partial sectional view showing the arrangement of the main part of the color image forming apparatus according to the present invention.

As indicated by the partial sectional view of FIG. 3, the secondary transfer roller 5A has a brush roller 261A, a solid lubricant 262A, and a spring 264A which presses the lubricant against the brush roller 261A. The pressing force is set to 1.96 N, and the thrust of the solid lubricant 262A in the brush roller 261A is set to about 1 mm. As the surface of the secondary transfer roller 5A is lubricated through the brush roller 261A, and the surface of the endless belt intermediate transfer member 70 is lubricated, the surface tensions decrease. That is, as the contact angle θ with respect to pure water increases, the wettability decreases to allow the toner image on the endless belt intermediate transfer member 70 to be transferred onto the transfer medium P more easily. In the prior art, for example, even in secondary transfer operation like that described above, excessive transfer pressure causes toner cohesion, resulting in a poor transfer phenomenon. The present invention is free from such a poor transfer phenomenon and the like due to toner cohesion, and can obtain stable, high-quality transferred images.

Each of the times T, T1, and T2 of transfer mediums through the above primary and secondary transfer positions was set to 27 ms, and the measurement intervals for the contact angle were set to 20 ms.

During an image forming process, the primary transfer roller 24K is always in tight contact with the photosensitive body 21K. The remaining primary transfer rollers 24Y, 24M, and 24C are brought into tight contact with the corresponding photosensitive bodies 21Y, 21M, and 21C only at the time of color image formation.

The secondary transfer roller 5A serving as a secondary transfer means is brought into tight contact with the endless belt intermediate transfer member 70 only when the transfer medium P passes therethrough and secondary transfer is performed.

A housing 8 constituted by the image forming sections 10Y, 10M, 10C and 10K and endless belt intermediate transfer member unit 7 can be drawn out of the main body A through support rails 82L and 82R.

The image forming sections 10Y, 10M, 10C, and 10K are arranged in a line in almost the vertical direction. The endless belt intermediate transfer member unit 7 is placed on the left side of the photosensitive bodies 21Y, 21M, 21C, and 21K in FIG. 2.

The endless belt intermediate transfer member unit 7 is comprised of the endless belt intermediate transfer member 70 serving as a pivotal intermediate transfer body wound around a driving roller 72, driven rollers 71 and 73, and a backup roller 74, the primary transfer rollers 24Y, 24M, 24C, and 24K, and the cleaning means 6A.

When the housing 8 is pulled out, the image forming sections 10Y, 10M, 10C, and 10K and the endless belt intermediate transfer member unit 7 are pulled out of the main body A together.

The support rail 82L of the housing 8 which is located on the left side in FIG. 2 is placed in a spatial portion above the fixing unit 50 on the left side of the endless belt intermediate transfer member 70. The support rail 82R of the housing 8 which is located on the right side in FIG. 2 is placed near a position near below the lowermost developing means 23K. The support rail 82R is placed at a position where the developing means 23Y, 23M, 23C, and 23K can be attached/detached without any trouble.

As also shown in FIG. 2, a nip forming roller 76 which presses the endless belt intermediate transfer member 70 against the photosensitive bodies 21Y, 21M, 21C, and 21K, from inside the transfer member, is placed on the upstream side of the transfer section for transfer operation from the photosensitive bodies 21Y, 21M, 21C, and 21K to the endless belt intermediate transfer member 70. With this arrangement, the nip amount between the intermediate transfer body and each photosensitive body can be adjusted.

Contact angle adjustment with respect to pure water during the time of passage through the above contact transfer area is preferably performed by the application of a lubricant. This contact angle is also preferably adjusted by adjustment of surface roughness. Furthermore, this contact angle adjustment is preferably performed by wettability adjustment based on plasma discharge.

As the above primary and secondary transfer means, transfer rollers made of an elastic material are preferably used because contact characteristics with respect to transfer mediums are excellent, and such rollers can be easily and accurately manufactured.

As the transfer means, a constant current source designed to output a constant current of 1 to 200 $\mu$A which has a polarity opposite to that of charged toner is preferably used because ozone is hardly produced and no poor transfer by excessive transfer current occurs.

The primary and secondary transfer rollers preferably have real resistances of $1\times10^5$ to $1\times10^{10}\Omega$ in terms of circuit arrangement.

The above toner preferably has a number average particle diameter of 3 to 8 $\mu$m in consideration of image quality and toner consumption saving.

Each of the photosensitive bodies preferably has a drum-like shape because such a shape allows an easy, accurate process.

The secondary transfer means for the transfer medium P is constituted by the intermediate transfer body and the backup roller and secondary transfer roller which sandwich the intermediate transfer body. Constant current control is performed such that the resistance of the backup roller is set to $1\times10^5$ to $1\times10^7\Omega$, and the resistance of the secondary transfer roller is set to $1\times10^5$ to $1\times10^7\Omega$. Such control operation is preferable ozone is hardly produced, and no poor transfer by excessive transfer current occurs.

In consideration of image quality and toner consumption, the coefficient of variation for the shape factor of the above toner is preferably 16% or less, and the number coefficient of variation in a number particle size distribution is preferably 27% or less.

The relative positions of each of the primary transfer rollers 24Y, 24M, 24C, and 24K, serving as the primary transfer means for primary transfer operation from the photosensitive bodies 21Y, 21M, 21C, and 21K to the endless belt intermediate transfer member 70, and a corresponding one of the photosensitive bodies preferably fall within 10 mm from the central point of the contact area between each of the photosensitive bodies 21Y, 21M, 21C, and 21K to the endless belt intermediate transfer member 70 on the upstream or downstream side in the rotational direction. This is because each photosensitive body comes into contact with the intermediate transfer body uniformly and properly, and stable transfer characteristics can be realized.

Table 1 shows the relationship between the distance from the central point of the contact area between each photosensitive body and the intermediate transfer body to a corresponding one of the primary transfer rollers, the toner scatter preventing effect, and the effect on transfer characteristics.

TABLE 1

| Distance from Central Point of Contact Angle between Photosensitive Body and Intermediate Transfer Body to Primary Transfer Roller (mm) | Toner Scatter Preventing Effect | Effect on Transfer Characteristics |
|---|---|---|
| 20 | ○ | X |
| 10 | ○ | ○ |
| 5 | ○ | ○ |
| 0 | X | ○ |
| −5 | X | ○ |
| −10 | X | ○ |
| −20 | X | X |

In the image forming apparatus of the present invention, in consideration of the occurrence of toner scatter, as indicated by Table 1, the primary transfer rollers 24Y, 24M, 24C, and 24K serving as the primary transfer means are preferably located downstream of the central points of the contact areas between the endless belt intermediate transfer member 70 and the respective photosensitive bodies 21Y, 21M, 21C, and 21K in the traveling direction of the intermediate transfer body.

In the image forming apparatus of the present invention, the relative position of each secondary transfer means for secondary operation from the endless belt intermediate transfer member 70 to the transfer medium P preferably falls within 20 mm from the central point of the contact area between the endless belt intermediate transfer member 70 and the transfer medium P such as a paper sheet on the downstream or upstream in the rotational direction. This is because the pressing force of the secondary transfer roller 5A against the endless belt intermediate transfer member 70 is about 10 times higher than that of the primary transfer roller against the photosensitive body, and the nip amount is large, and hence as indicated by Table 2, a uniform, proper contact state is ensured within 20 mm on the upstream or downstream in the traveling direction of the endless belt intermediate transfer member 70. However, as indicated by Table 2, from the viewpoint of toner scatter, the relative position is not preferably located on the upstream side but is preferably located on the downstream side.

TABLE 2

| Distance from Central Point of Contact Area between Intermediate Transfer Body and Backup Roller to Secondary Transfer Roller (mm) | Toner Scatter Preventing Effect | Effect on Transfer Characteristics |
|---|---|---|
| 40 | ○ | X |
| 30 | ○ | X |
| 20 | ○ | ○ |
| 10 | ○ | ○ |
| 0 | X | ○ |
| 10 | X | ○ |
| −20 | X | ○ |
| −30 | X | X |
| −40 | X | X |

As indicated by the partial sectional view of FIG. 3, a movable nip forming roller for adjusting the nip amount between the endless belt intermediate transfer member 70 and each of the photosensitive bodies 21Y, 21M, 21C, and 21K is preferably provided, and the nip forming roller is preferably released except for image forming operation in terms of increasing the durability of the intermediate transfer body 70.

The nip forming roller is preferably made of a metal and has no driving means for rotation in order to smoothly form a nip.

As the toner for the above toner image, a two-component developing agent constituted by toner and carrier is preferably used in consideration of image quality and the effective use of the toner.

Three Experimental Examples executed by actually operating the image forming apparatus of the present invention will be described next.

FIRST EXPERIMENTAL EXAMPLE

The monochrome copying machine shown in FIG. 1 was used. The following are the main specifications of this machine.

The line speed was 180 mm/s.

The drum diameter of the photosensitive body was 60 mm. The photosensitive body was coated with an organic semiconductive layer formed by dispersing a phthalocyanine pigment in polycarbonate. The thickness of the photosensitive body layer including a charge transport layer was wet to 25 $\mu$m.

The potential of the non-image portion of the photosensitive body was detected by a potential sensor and subjected to feedback control (controllable range was from −500 V to −900 V), and the total exposure potential was set to −50 to 0 V.

Exposure was performed according to a laser scanning scheme using a semiconductor laser (LD), and the output was set to 300 $\mu$W.

Development was performed by a two-component developing scheme.

A primary transfer roller (foam roller) serving as a primary transfer means having an outer diameter of 20 mm and a resistance of $1\times10^5\Omega$ was placed to oppose the surface of the photosensitive body, and 20 $\mu$A constant current control was performed.

Fixing was performed by roller fixing using the fixing unit 50 incorporating a heater.

The distance from the photosensitive body on the endless belt intermediate transfer member 70 to the adjacent photosensitive body was set to 95 mm.

The outer diameter of the primary transfer roller serving as the primary transfer means was set to 20 mm.

The pressing force of the primary transfer roller was set to 4.9 N.

The concentration of toner in the developing unit serving as a developing means was set to 4 mass %.

As a lubricant, a solid lubricant made of 100% of zinc stearate (Zn-St) with a size of 8×10×335 mm was used.

As the cleaning brush roller 261, a roller having a diameter of 18 mm and a length of 335 mm available from Toray Industries Inc. (product number SA-7 with 6.25 denier and 100,000/6.45 $cm^2$) was used. The line speed of the cleaning brush roller 261 was set to 180 mm/s (counter rotation in a direction opposite to the rotational direction of the photosensitive body 21).

In a coating mechanism, the thrust between the cleaning brush roller 261 and the photosensitive body 21 was set to 1 mm. The solid lubricant 262 was pressed against the cleaning brush roller 261 with a total load of 1.96 N.

When contact angles were measured under the above conditions, the curve (A) shown in FIG. 4 was obtained. Obviously, the contact angle θ could be made sufficiently larger than that indicated by the curve (B).

With the above arrangement, 200,000 printouts were obtained without any troubles in terms of images.

SECOND EXPERIMENTAL EXAMPLE

An experiment was conducted by using the tandem type intermediate transfer full-color copying machine shown in FIG. 2, which is the image forming apparatus according to the second embodiment of the present invention. The following are the main specifications of this machine.

The line speed was 180 mm/s.

The drum diameter of each of the photosensitive bodies 21Y, 21M, 21C, and 21K was 60 mm. The photosensitive body was coated with an organic semiconductive layer formed by dispersing a phthalocyanine pigment in polycarbonate. The thickness of the photosensitive body layer including a charge transport layer was wet to 25 μm.

The potential of the non-image portion of each of the photosensitive bodies 21Y, 21M, 21C, and 21M was detected by a potential sensor and subjected to feedback control (controllable range was from −500 V to −900 V), and the total exposure potential was set to −50 to 0 V.

Exposure was performed according to a laser scanning scheme using a semiconductor laser (LD), and the output was set to 300 μW.

Development was performed by a two-component developing scheme.

The endless belt intermediate transfer member 70 was used as an intermediate transfer body, which was a seamless semiconductive resin belt (volume resistivity: $1\times10^8$ Ωcm).

As the primary transfer rollers 24Y, 24M, 24C, and 24K serving as primary transfer means, foam rollers (each having an outer diameter of 20 mm and a resistance of $1\times10^6\Omega$) were mounted on the rear surface of the endless belt intermediate transfer member 70, and 20 μA constant current control was performed in primary transfer operation As the secondary transfer roller 5A serving as a secondary transfer means, a semiconductive roller was pressed against the endless belt intermediate transfer member 70 from the lower surface of the transfer medium P, and 80-A constant current control was performed.

Fixing was performed by roller fixing using the fixing unit 50 incorporating a heater.

The distance from the photosensitive body on the endless belt intermediate transfer member 70 to the photosensitive body of the next color was set to 95 mm.

The outer diameter of the backup roller 74, which clamps the endless belt intermediate transfer member 70 together with the tension roller 71, driving roller 72, and secondary transfer roller 5A, was set to 31.6 mm.

The outer diameter of each of the primary transfer rollers 24Y, 24M, 24C, and 24K serving as primary transfer means was set to 20 mm.

The tension of the endless belt intermediate transfer member 70 was set to 49 N.

The pressing force of each of the primary transfer rollers 24Y, 24M, 24C, and 24K was set to 4.9 N.

The concentration of toner in the developing unit serving as a developing means was set to 4 mass %.

As a lubricant, a solid lubricant made of 100% of zinc stearate (Zn-St) with a size of 8×10×335 mm was used.

As the cleaning brush roller 261, a roller having a diameter of 18 mm and a length of 335 mm available from Toray Industries Inc. (product number SA-7 with 6.25 denier and 100,000/6.45 $cm^2$) was used. The line speed of the cleaning brush roller 261 was set to 180 mm/s (counter rotation in a direction opposite to the rotational direction of the photosensitive body 21).

In a coating mechanism, the thrust depth of the cleaning brush roller into each photosensitive body was set to 1 mm. The solid lubricant was pressed against the cleaning brush roller with a total load of 1.96 N.

When contact angles were measured under the above conditions, the curve (A) shown in FIG. 4 was obtained. Obviously, the contact angle could be made sufficiently larger than that indicated by the curve (C).

With the above arrangement, 200,000 printouts were obtained without any troubles in terms of images.

THIRD EXPERIMENTAL EXAMPLE

An experiment was conducted by using the tandem type intermediate transfer full-color copying machine shown in FIG. 3, which is the image forming apparatus according to the third embodiment of the present invention. The following are the main specifications of this machine.

The line speed was 180 mm/s.

The drum diameter of each of the photosensitive bodies 21Y, 21M, 21C, and 21K was 60 mm. The photosensitive body was coated with an organic semiconductive layer formed by dispersing a phthalocyanine pigment in polycarbonate. The thickness of the photosensitive body layer including a charge transport layer was wet to 25 im.

The potential of the non-image portion of each of the photosensitive bodies 21Y, 21M, 21C, and 21M was detected by a potential sensor and subjected to feedback control (controllable range was from −500 V to −900 V), and the total exposure potential was set to −50 to 0 V.

Exposure was performed according to a laser scanning scheme using a semiconductor laser (LD), and the output was set to 300 μW.

Development was performed by a two-component developing scheme.

The endless belt intermediate transfer member 70 was used as an intermediate transfer body, which was a seamless semiconductive resin belt (volume resistivity: $1\times10^8$ Ωcm).

As the primary transfer rollers 24Y, 24M, 24C, and 24K serving as primary transfer means, foam rollers (each having an outer diameter of 20 mm and a resistance of $1\times10^6\Omega$) were mounted on the rear surface of the endless belt intermediate transfer member 70, and 20 μA constant current control was performed in primary transfer operation.

As the secondary transfer roller 5A serving as a secondary transfer means, a semiconductive roller was pressed against the endless belt intermediate transfer member 70 from the lower surface of the transfer medium P, and 80 μA constant current control was performed.

Fixing was performed by roller fixing using the fixing unit 50 incorporating a heater.

The distance from the photosensitive body on the endless belt intermediate transfer member 70 to the photosensitive body of the next color was set to 95 mm.

The outer diameter of the backup roller 74, which clamps the endless belt intermediate transfer member 70 together with the tension roller 71, driving roller 72, and secondary transfer roller 5A, was set to 31.6 mm (95 mm/3).

The outer diameter of each of the primary transfer rollers 24Y, 24M, 24C, and 24K serving as primary transfer means was set to 20 mm.

The tension of the endless belt intermediate transfer member 70 was set to 49 N.

The pressing force of each of the primary transfer rollers 24Y, 24M, 24C, and 24K was set to 4.9 N.

The concentration of toner in the developing unit serving as a developing means was set to 4 mass %.

As a lubricant, the solid lubricant 262 made of 100% of zinc stearate (Zn-St) with a size of 8×10×335 mm was used.

As the brush roller 261A, a roller having a diameter of 18 mm and a length of 335 mm available from Toray Industries Inc. (product number SA-7 with 6.25 denier and 100,000/6.45 $cm^2$) was used. The line speed of the cleaning brush roller 261 was set to 180 mm/s (counter rotation in a direction opposite to the rotational direction of the photosensitive body 21).

In a coating mechanism, the thrust depth of the brush roller 261A into the secondary transfer roller 5A was set to 1 mm. The solid lubricant 262A was pressed against the brush roller 261A with a total load of 1:96 N.

When contact angles were measured under the above conditions, the result indicated by the curve (D) shown in FIG. 4 was obtained. The lubricant indicted by the curve (D), which was applied to the secondary transfer roller 5A, was transferred onto the intermediate transfer body 70, and the contact angles θ which were sufficiently adjusted to the photosensitive bodies and transfer medium can be obtained, as indicated by the curve (C).

With the above arrangement, 200,000 printouts were obtained without any troubles in terms of images.

Note that a contact angle meter available from Kyowa Kaimen Kagaku K.K., Japan was used for measurement of contact angles in the present invention.

What is claimed is:

1. An image forming apparatus, comprising: transfer means to transfer a toner image formed on the photosensitive body surface by making use of toner onto one surface of a transfer medium, characterized in that, when a time of passage through a contact transfer area between the photosensitive body and the transfer medium in a process of transferring the toner image from the photosensitive body onto the transfer medium is T sec, a contact angle of the photosensitive body with respect to pure water applied to the photosensitive body surface after a lapse of T sec since application of the pure water is larger than a contact angle of the transfer medium with respect to the pure water after a lapse of the T sec.

2. An apparatus according to claim 1, wherein said transfer means comprises primary transfer means for bringing one surface of a transfer medium into contact with a photosensitive body surface and pressing the surface of said transfer medium against the photosensitive body surface.

3. An apparatus according to claim 1, wherein said transfer means comprises primary transfer means for bringing one surface of an intermediate transfer body into contact with a photosensitive body surface and pressing the surface of said intermediate transfer body against the photosensitive body surface to transfer a toner image formed on the photosensitive body surface by making use of toner onto one surface of the intermediate transfer body, and secondary transfer means for bringing a transfer surface of the intermediate transfer body and one surface of a transfer medium into contact with each other and compressing the transfer surface and one surface of the transfer medium against each other to transfer the toner image formed on the transfer surface of the intermediate transfer body onto one surface of the transfer medium, characterized in that when a time of passage through a contact transfer area between the photosensitive body and the intermediate transfer body in a process of transfer operation from the photosensitive body to the intermediate transfer body is T1 sec, a contact angle of the photosensitive body with respect to pure water applied to the photosensitive body surface after a lapse of T1 sec since application of the pure water is larger than a contact angle of the intermediate transfer body with respect to the pure water after a lapse of the T1 sec, and that when a time of passage through a contact transfer area between the intermediate transfer body and the transfer medium in a process of transfer operation from the intermediate transfer body to the transfer medium is T2 sec, a contact angle of the intermediate transfer body with respect to pure water applied to a surface of the intermediate transfer body after a lapse of T2 sec since application of the pure water is larger than a contact angle of the transfer medium with respect to the pure water after a lapse of the T2 sec.

4. An apparatus according to claim 3, characterized in that when a time of passage through a contact transfer area between the intermediate transfer body and the transfer medium in a process of transfer operation from the intermediate transfer body to the transfer medium is T sec, a contact angle of the intermediate transfer body with respect to pure water applied to a surface of the intermediate transfer body after a lapse of T sec since application of the pure water is larger than a contact angle of said secondary transfer means with respect to the pure water after a lapse of the T sec.

5. An apparatus according to claim 1, wherein contact angle adjustment for pure water in the time of passage through the contact transfer area is performed by applying a lubricant.

6. An apparatus according to claim 1, wherein contact angle adjustment for pure water in the time of passage through the contact transfer area is performed by adjustment of surface roughness.

7. An apparatus according to claim 1, wherein contact angle adjustment for pure water in the time of passage through the contact transfer area is performed by wettability adjustment based on plasma discharge.

8. An apparatus according to claim 1, wherein transfer rollers formed from an elastic member are used as said transfer means.

9. An apparatus according to claim 1, wherein a constant current source which outputs a constant current of 1 to 200 $\mu$A with a polarity opposite to that of charged toner is used as said transfer means.

10. An apparatus according to claim 8, wherein said transfer roller has a real resistances of $1\times10^5$ to $1\times10^{10}$ Ω.

11. An apparatus according to claim 1, wherein said toner has a number average particle diameter of 3 to 8 $\mu$m.

12. An apparatus according to claim 1, wherein said photosensitive body has a drum-like shape.

13. An apparatus according to claim 3, wherein said secondary transfer means for the transfer medium comprises an intermediate transfer body and a backup roller and secondary transfer roller which sandwich the intermediate transfer body, and performs constant current control, with the backup roller having a resistance of $1\times10^{15}$ to $1\times10^7$ Ω, and the secondary transfer roller having a resistance of $1\times10^5$ to $1\times10^7$ Ω.

14. An apparatus according to claim 1, wherein a coefficient of variation for a shape factor of the toner is not more than 16%, and a number coefficient of variation in a number particle size distribution is not more than 27%.

15. An apparatus according to claim 3, wherein a relative position of said primary transfer means is within 10 mm on upstream and downstream sides of the central point of a contact transfer area between the photosensitive body and the intermediate transfer body in a rotational direction.

16. An apparatus according to claim 3, wherein said primary transfer means is located downstream of the central point of a contact transfer area between the intermediate transfer body and the photosensitive body in a traveling direction of the intermediate transfer body.

17. An apparatus according to claim 3, wherein a relative position of a secondary transfer roller serving as said secondary transfer means for performing transfer operation from the intermediate transfer body to the transfer medium is within 20 mm on upstream and downstream sides of the central point of a contact area between the intermediate transfer body and a backup roller in a rotational direction.

18. An apparatus according to claim 3, wherein a nip forming roller which forms a nip between the photosensitive body and the intermediate transfer body is movable and is released except for image forming operation.

19. An apparatus according to claim 18, wherein said nip forming roller is made of a metal and has no driving means for rotation.

20. An apparatus according to claim 3, wherein said intermediate transfer body is placed in correspondence with a plurality of photosensitive bodies and developing units.

21. An apparatus according to claim 20, wherein toner images are primarily transferred from the plurality of photosensitive bodies to one intermediate transfer body, and the toner images on the intermediate transfer body are secondarily transferred onto a transfer medium together.

22. An apparatus according to claim 1, wherein a two-component developing agent constituted by toner and a carrier is used as said toner.

* * * * *

UNITED STATES PATENT AND TRADEMARK OFFICE

CERTIFICATE OF CORRECTION

PATENT NO. : 6,760,562 B2
DATED : July 6, 2004
INVENTOR(S) : Satoshi Nishida

It is certified that error appears in the above-identified patent and that said Letters Patent is hereby corrected as shown below:

Title page,
Item [56], References Cited, U.S. PATENT DOCUMENTS, add, -- 5,732,314 A * 3/1998 Tsukida et al . . .
5,761,594 A * 6/1998 Seto et al . . . -- add, -- FOREIGN PATENT DOCUMENTS;

| | | | |
|---|---|---|---|
| EP | 0 874 291 | A1 | 10/1998 |
| JP | 07-152263 | | 6/1995 |
| JP | 08-211755 | | 8/1996 -- |

Signed and Sealed this

Thirty-first Day of August, 2004

JON W. DUDAS
*Director of the United States Patent and Trademark Office*